United States Patent [19]

Rowe

[11] Patent Number: 4,927,012

[45] Date of Patent: May 22, 1990

[54] PACKAGING ASSEMBLY FOR SUBSTANCES TO BE POST-MIXED

[76] Inventor: John P. Rowe, 321 Green Hill Road, Madison, Conn. 06443

[21] Appl. No.: 305,620

[22] Filed: Feb. 3, 1989

[51] Int. Cl.[5] ..... B65D 25/08

[52] U.S. Cl. ..... 206/219; 206/604; 220/20

[58] Field of Search ..... 206/219, 222, 277, 221, 206/604; 220/49, 21, 22, 20

[56] References Cited

U.S. PATENT DOCUMENTS

| | | | |
|---|---|---|---|
| 1,585,911 | 5/1926 | Hevblein | 206/219 |
| 2,058,251 | 10/1936 | Nitardy et al. | 206/219 |
| 2,687,130 | 8/1954 | Cohen | 206/222 |
| 2,954,144 | 9/1960 | Elam et al. | 206/222 |
| 3,458,076 | 7/1969 | Babcock | 206/221 |
| 3,539,794 | 11/1970 | McKay Rauhut et al. | 206/221 |
| 3,596,801 | 8/1971 | Barnack | 206/222 |
| 4,057,047 | 11/1977 | Cossett | 206/219 |
| 4,458,811 | 7/1984 | Wilkinson | 206/219 |
| 4,657,134 | 4/1987 | Woodworth et al. | 206/219 |

FOREIGN PATENT DOCUMENTS

| | | | |
|---|---|---|---|
| 2506726 | 12/1982 | France | 206/222 |

OTHER PUBLICATIONS

Modern Packaging Magazine Title: "Twin-Tube Adhesives" Jul. 1956 pp. 82–83.

*Primary Examiner*—Paul T. Sewell
*Assistant Examiner*—Jacob K. Ackon, Jr.
*Attorney, Agent, or Firm*—Ira S. Dorman

[57] ABSTRACT

A packaging assembly for two different substances, which are to be mixed by the consumer, consists of an ampule containing one substance, enclosed within a tube containing the other. Both components are made of plastic, and at least the ampule is so constructed as to permit it to be opened by manual compressive force applied through the tube body. The cavities of the ampule and tube are desirably closed simultaneously, as by forming a common heat seal across them.

6 Claims, 2 Drawing Sheets

FIG. 4A
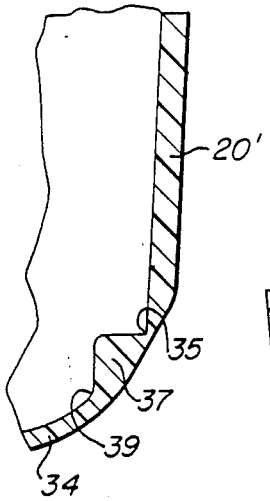
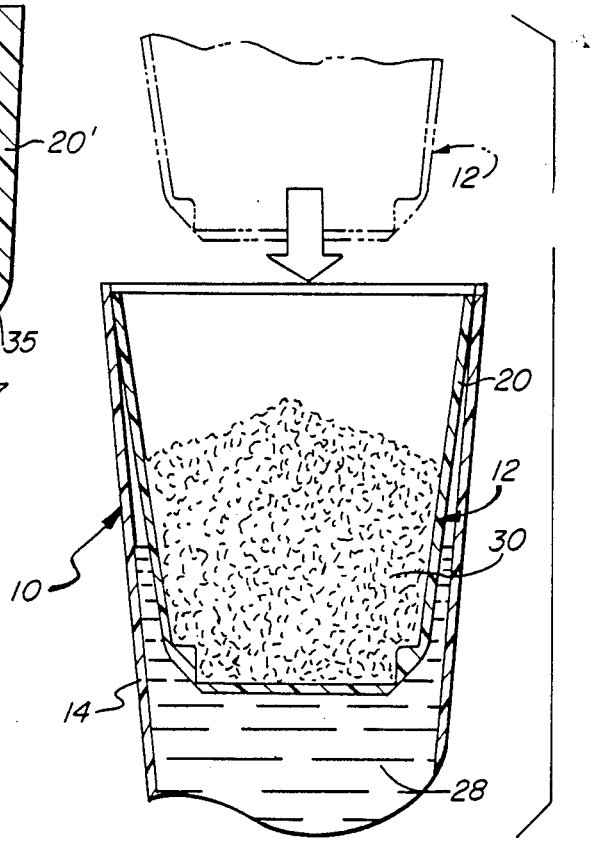
FIG. 5
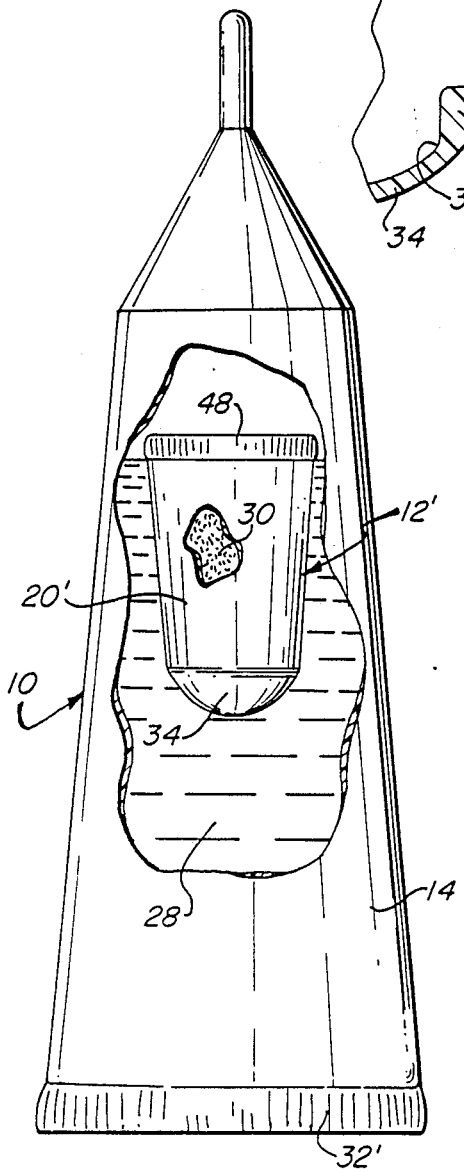
FIG. 4
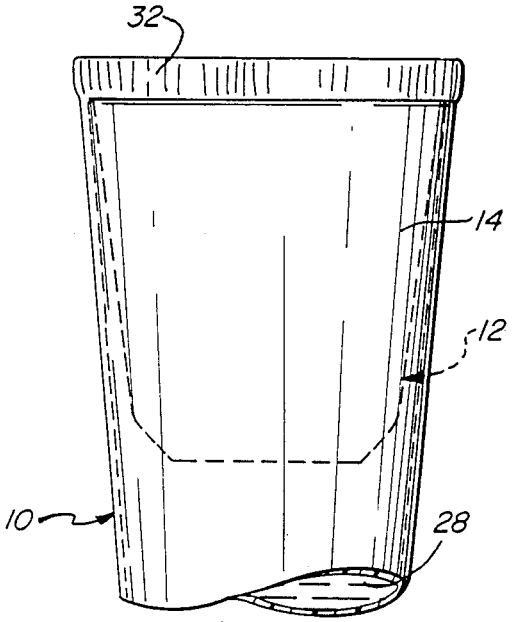
FIG. 6

PACKAGING ASSEMBLY FOR SUBSTANCES TO BE POST-MIXED

BACKGROUND OF THE INVENTION

Many products consist of different substances that are necessarily or desirably mixed with one another just before use. One example is an epoxy adhesive, in which the adhesive constituents and the chemical hardener must be kept separate until the product is about to be applied. Other such products include cosmetics (e.g., hair coloring), pharmaceuticals (e.g., lyophilized antibiotics and vitamins), and comestibles, admixture being carried out, in some instances, simply to reconstitute a dried or concentrated essential ingredient by dissolving it in water.

There are of course substantial advantages in providing the separate parts of any such product as a unitary package. Doing so not only facilitates or simplifies any overwrapping or unitizing packaging that would otherwise be required, but it also adds to the convenience of storage and use by the consumer, who is relieved, for example, of any need to measure amounts of substances to provide proper proportions or dosages, as the case may be. Further convenience would be afforded, moreover, by the provision of a packaging unit that is itself capable of serving as the vessel in which the ingredients are mixed.

Accordingly, it is the broad object of the present invention to provide a novel packaging assembly for two different substances that are to be post-mixed by the consumer.

A more specific object is to provide such an assembly comprised of components that are fixed in position relative to one another, so as to facilitate admixture of the contained substances.

Another object is to provide an assembly having the foregoing features and advantages, which is of simple and economical construction, and wherein the components are readily and reliably opened by manual force.

A further object of the invention is to provide a novel method for the production of a packaging assembly having the foregoing features and advantages, which method is relatively facile and economical to carry out.

SUMMARY OF THE INVENTION

It has now been found that certain of the foregoing and related objects of the invention are attained by the provision of a packaging assembly comprised of a tube that is integrally formed as a single piece from a synthetic resinous material, and a smaller, similarly formed ampule contained therewithin. The tube has forward and rearward ends, with a continuous cavity of forwardly diminishing cross section extending through it and containing a first flowable substance. A pliant body portion, at the rearward end of the tube, has a terminal part defining an opening into its cavity, and a closed nozzle portion is provided at its forward end. The ampule also has forward and rearward ends, with a continuous cavity of forwardly diminishing cross section extending through it and containing a second flowable substance. It too includes a pliant body portion at its rearward end, with a terminal part defining an opening into its cavity, and a closed frangible portion at its forward end; the frangible portion of the ampule is adapted to be fractured under manually applied compressive force. Most desirably, the terminal parts of the body portions of the ampule and the tube will be in mutual registry, and will be closed by a common transverse element which maintains the components in a fixed relationship to one another.

In preferred embodiments the frangible portion of the ampule will be comprised of a generally cylindrical sidewall element with an outer end; a blunt end wall element extending across the forward end of the ampule; and a transition element extending between the outer end of the sidewall element and the end wall element, and connecting them to one another. The transition element forms a sharp internal angle, having a value of about 90° or less, at the intersection with either the end wall element or the sidewall element, and it most desirably forms an internal arcuate surface at the intersection with the other one of those elements. Compressive force applied in the region of the transition element will concentrate stress at the "one" (sharp angle) intersection, thereby tending to cause fracture thereat for opening of the ampule.

In most cases the material of which the tube is made will be substantially thinner at the "one" intersection of the elements than it is in the elements themselves, and the end wall element will beneficially be either substantially planar or in the form of a spheric section. In especially preferred embodiments the outside dimensions of the ampule body terminal part will be substantially similar to the inside dimensions of the tube body terminal part. This will afford a loose friction fit between the components when the ampule is inserted into the tube body portion with the terminal parts in mutual registry, and will facilitate production of the assembly.

Other objects of the invention are attained by the provision of a method for producing an assembly, utilizing a tube and ampule having the structural features hereinabove set forth. The method involves partially filling the cavity of the tube with a first substance and thereafter inserting the ampule into the tube, bringing the terminal parts of the two body portions into mutual registry with one another. The cavity of the ampule is then at least partially filled with a second substance, after which the terminal parts of the tube and ampule body portions are simultaneously closed by a common seal extending across them. The components will preferably be sized to produce a loose friction fit between the registered terminal parts.

BRIEF DESCRIPTION OF THE DRAWINGS

FIG. 4 is an elevational view of a second embodiment of the assemblies of the present invention, with portions broken away to expose internal features and details;

FIG. 4A is a fragmentary sectional view, drawn to an enlarged scale, showing details of construction at the frangible portion of the ampule employed in the assembly of FIG. 4;

FIG. 5 is a fragmentary sectional view showing the components of the assembly of FIGS. 1–3 in the course of production thereof, the pre-insertion position of the ampule being shown in phantom line ; and FIG. 6 is a fragmentary elevational view showing the completed assembly.

DETAILED DESCRIPTION OF THE ILLUSTRATED EMBODIMENTS

Figure 1:
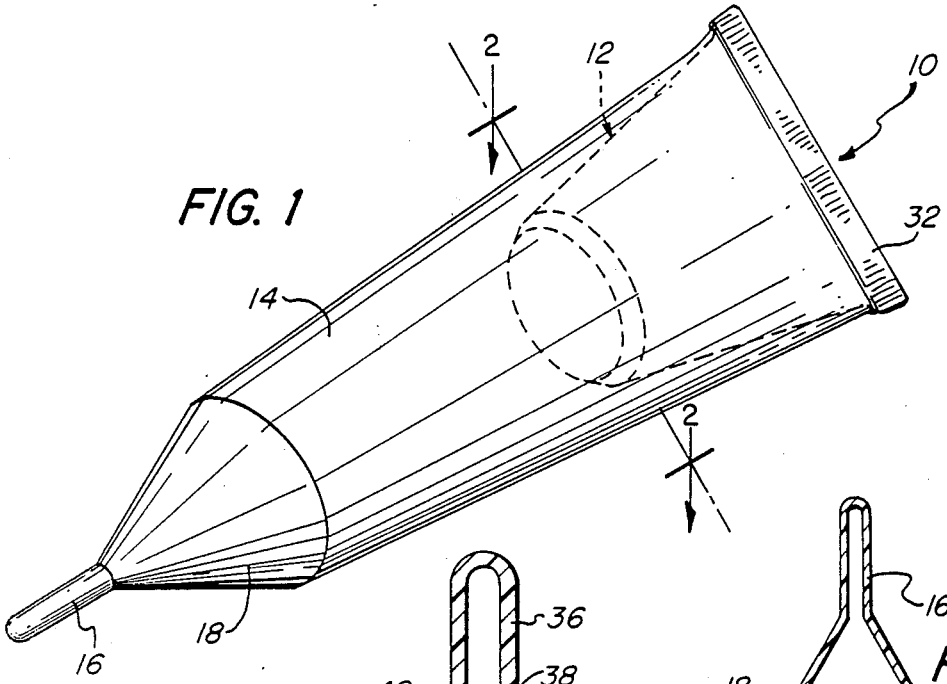
FIG. 1 is a perspective view of an assembly embodying the present invention.
Figure 2A:
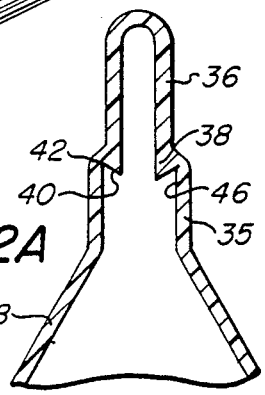
FIG. 2A is a fragmentary view, drawn to an enlarged scale, showing an alternative form of the tip structure that may be used on the tube of the assembly.
Figure 2:
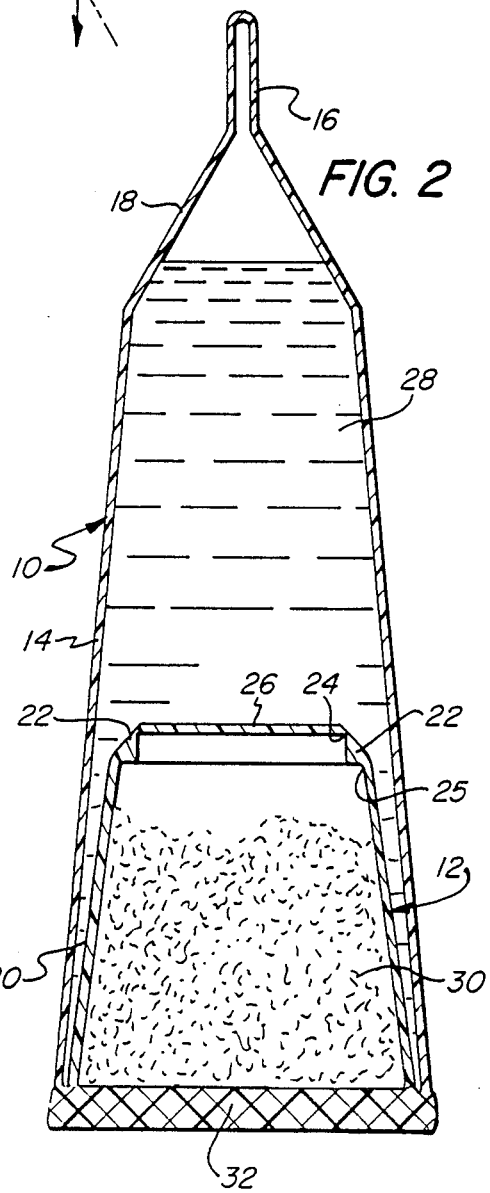
FIG. 2 is a sectional view of the assembly of FIG. 1, taken along line 2—2 thereof.
Figure 3:
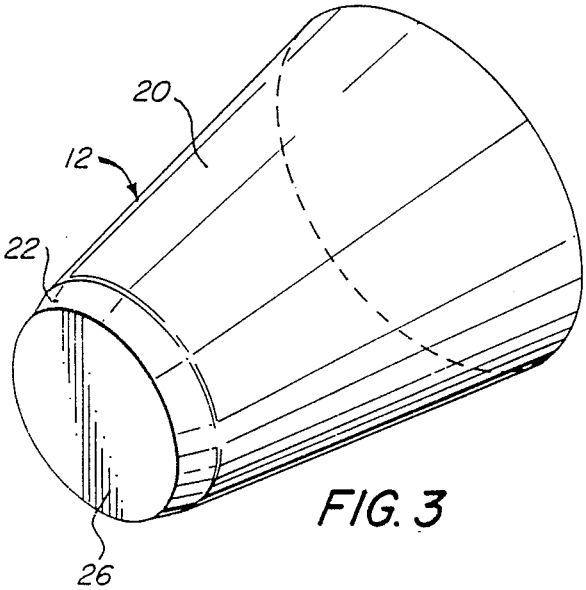
FIG. 3 is a perspective view of the open ampule employed in the assembly of the foregoing figures.

Turning now in detail to FIGS. 1–3 of the appended drawings, therein illustrated is a packaging assembly embodying the present invention and consisting of a hollow tube, generally designated by the numeral 10, and an ampule generally designated by the numeral 12. The tube consists of a body portion 14, and a nozzle portion having a long, small-diameter tip section 16 joined to the body portion 14 by a frustoconical section 18.

The ampule 12 is also hollow, and consists of a body portion 20 with a frangible portion at its forward end. As best seen in FIGS. 2 and 3, the frangible portion comprises a shoulder section 22 connecting the body portion 20 and the planar end wall element 26. The shoulder section 22 forms an internal angle of slightly more than 90° with the end wall element 26, producing a sharp apex at the intersection 24, and it forms an internal arcuate surface at the intersection 25 with the body portion 20; as can be seen, the material of the ampule is thinned substantially at 24 and is of substantially full thickness at 25.

In the particular case illustrated, the cavity of the tube 10 is filled with a liquid 28, and that of the ampule 12 is filled with a powder 30. Terminal sections, defining openings into the body portions 14, 20 of the tube and ampule, respectively, are in registry with one another, and are closed at 32 by a common heat seal. It will be appreciated that the heat seal serves not only to close the cavities of both components, but also to anchor the ampule in fixed position within the tube.

In use, the ampule is opened by squeezing its frangible portion, with the tube body portion 14 yielding sufficiently for that purpose. Depending upon the flow characteristics of the contained substance, it may be particularly beneficial to fabricate the ampule from a pliant material, so as to accommodate any compression that may be desirable to assist in emptying the substance from its cavity. At the same time, it will be appreciated that the material must be sufficiently rigid that the force applied to its frangible portion will effectively initiate fracture. The end wall 26 on the ampule contributes to this result by imposing resistance to compression, thereby generating stresses at its intersection with the contiguous element of the shoulder section 22.

After the contents of the ampule 12 have been discharged, through the opening formed by fracture of the frangible portion and displacement of the end wall 26, the substance 30 can be mixed with the substance 28 contained in the cavity of the tube body portion 14. This may be done simply by shaking the package, if at least one of the constituents (normally that which is present in the greater volumetric amount) is of sufficiently low viscosity; alternatively, because of the pliancy of the tube body the contents may be kneaded as necessary to effect thorough mixing. The connection between the ampule and tube provided by the common heat seal 32 not only facilitates expression of the substance 30, by keeping the ampule in place against the forces applied, but it also minimizes any interference to mixing that might otherwise be presented by the ampule; and as will be discussed hereinafter, it affords the additional advantage of facilitating manufacture of the assembly. When the two substances 28, 30 are sufficiently blended, the tip section 16 may simply be cut away to permit discharge of the mixture, normally by squeezing the body portion 14.

Numerous variations can of course be made to the assembly to modify or improve operation, to facilitate production, etc., as will be evident to those skilled to the art. One variation is illustrated in FIG. 2A, and serves to provide a manual opening feature for the tube nozzle portion, in lieu of the section 16, which must be cut away. The structure is more fully described in copending application for U.S. Letters Patent Ser. No. 07/064,832, filed on June 22, 1987 in the name of John P. Rowe and of common assignment herewith.

More particularly, the illustrated structure includes a neck portion 35 joined to the frustoconical section 18 and having a hollow stem element 36, closed at its tip, extending coaxially therefrom a substantial distance beyond its outer end. The stem element 36 is joined to the neck portion 35 by a base section 38, which is of nonuniform cross section and has a generally annular, inwardly tapered inside surface 40 thereon. It will be noted that the section 38 is relatively thick adjacent the base of the stem element 36, and that it tapers to a thin zone 42 at its circumferential edge, by virtue of the acute angle and relatively sharp apex formed between the annular surface 40 and the inside surface 46 of the neck section 35. Deflection of the stem element 36 from the axis of the structure, and relative to the neck section 35, will effect fracture of the material within the weakened circumferential zone 42, and thus permit removal of the stem element 36 and the attached base section 38.

Turning now to FIG. 4 of the drawings, therein illustrated is an alternative form of assembly embodying the present invention. The components are substantially the same as to those of which the assembly of FIG. 1 is comprised, the difference in the assembly residing essentially in the inverted position of the ampule 12' within the cavity of the tube body portion 14. This of course precludes simultaneous sealing and interengagement of the terminal sections of the components, and relinquishes the attendant advantages; accordingly, it represents a decidedly less preferred embodiment of the invention. Nevertheless, the assembly does offer the substantial benefits that are realized by the provision of a self-contained unitary package of substances that are to be post-mixed and, to that extent, it shares the inventive concepts of the more preferred embodiments.

FIGS. 4 and 4A show a further modification, which involves the substitution of an end wall element 34 of spheric section for the flat end wall element 26. Frangibility is afforded in the ampule by creating a sharp internal angle (again with a value of about 90°) at the intersection 35, formed by the circumferential marginal element 37 on the spheric wall 34, and the body portion 20. Thinning of the material of fabrication is produced at the intersection 35, and stresses which result from the application of compressive forces, to the frangible portion, are concentrated there. The circumferential element 37 is relatively thick, and it merges directly into the remainder of the spheric wall, with only a slight change in curvature of the inner surface 39 at the transition zone. Other blunt end configurations might also be employed.

In producing the assembly of FIG. 4, it will be appreciated that the ampule 12' would initially be filled and closed, as with a heat seal at 48, and then inserted into the cavity of the tube body portion 14. The latter may either be prefilled or filled subsequent to introduction of the ampule, after which it too will be closed, as with a heat seal at 32'.

FIGS. 6 and 7 illustrate the method of production of the preferred packaging assembly shown in FIGS. 1 and 2. As can be seen, the cavity of the body portion 14 of the tube 10 is initially filled with the contained substance 28, to a level such that headspace remains to a depth sufficient to accommodate the ampule 12 substantially entirely therewithin. As will be noted, the terminal portions (adjacent the open ends) of the body portions 14, 20 of the tube and ampule, respectively, are dimensioned so as to produce a slight friction fit therebetween. This helps to maintain the ampule in a stable position near the outer end of the tube body portion, making it a simple matter to introduce the substance 30 into the cavity of the ampule body portion, and then to simultaneously close the tube and ampule by formation of the transverse heat seal 32.

Both components of the assembly are fabricated from a synthetic resinous material, typical of which are polypropylene, high density polyethylene, nylon, copolyester resins, rigid polyvinyl chloride, and the like. The thickness of the component walls (which may be taken to mean virtually all sections, other than those that are thinned for weakening) will vary, depending upon the particular polymer involved; by way of example, however, polypropylene components will have a nominal wall thickness of 0.3 millimeter. The same plastic or plastic composition need not be employed for both components; indeed, since the characteristics necessary for optimal performance may differ, it may be preferable to employ one plastic for the tube and another for the ampule. Although the material used may be transparent or opaque, when the ampule is free floating it will be desirable to make the tube transparent, to facilitate locating the ampule for opening; when it is anchored, however, the point at which force should be applied can simply be designated on the tube.

As indicated above, the tube must be sufficiently pliant to permit the transmission of squeezing force therethrough to the ampule, and it should also enable kneading without cracking or other compromise of its integrity. By the same token, it may be desirable to form the tube from a material that will permit manual fracture of its nozzle portion (as described in connection with FIG. 2A here of), which of course implies a degree of rigidity. As will be appreciated by those skilled in the art, these characteristics are not necessarily inconsistent, and may be achieved simply by virtue of dimensional differences and thickness variations.

While the ampule may also be compressible, to facilitate discharge of its contents, it must of course afford the frangibility necessary to effect opening by the application of manual force. Here again, the dimensions and thicknesses of the material employed may be selected to provide the desired characteristics, appreciating however that the presence of the blunt end element is an important feature from the standpoint of producing stress concentrations to induce fracture of the frangible portion.

It is a notable aspect of the invention that both components of the packaging assembly are particularly well suited to fabrication by use of a fusion molding technique, using a thermoplastic polymer. As is known to those skilled in the art, such a technique utilizes a heated mold member or mandrel, which is partially submerged in a fluidized bed of the desired resin, in particulate form. The mold must of course be heated to a temperature sufficient to cause fusion of the polymer on its surface, and must be so configured as to reproduce the desired structural features internally of the component being manufactured. In this regard, the plastic employed must, in addition to having the physical properties described above, exhibit such rheology in the molten state as will enable faithful reproduction of the profile of the tooling in the molded part.

Perhaps it should be pointed out here that the outside chamfer, present opposite the acute angle intersections of the elements at, for example, 24 and 35 in FIGS. 2 and 4A, tends to form inherently in the fusion molding process, due to the flow characteristics of the molten resin over a sharp edge of the mold; it does not require the use of any external tooling, and contributes to the desired thinning of the plastic thereat. Similarly, a radiused edge or shoulder on the mold (responsible for the arcuate surface contours, at 25 and 39) will tend to produce a full thickness of plastic, through which applied force s will be transmitted to the adjacent sharp-angled intersections.

Generally, after a suitable thickness of coating has been developed on the submerged mandrel, it will be removed from the fluidized bed and introduced into a quench tank, to effect solidification. Any adhering water may be blown off, following which the formed component will be stripped from the mold. The utilization of steel bar stock that has been polished to remove imperfections, as well as the application of a mold release agent to the tooling at the start of each forming cycle, will facilitate the stripping action.

Finally, it should perhaps be emphasized that reference herein to an internal angle of "about 90°" is intended to encompass slightly larger angles, as might for example be due to the incorporation of a desired taper in the body portion of the tube and/or ampule. The more crucial factor is the existence of a sharp internal apex at the intersection of the elements, to maximize response to compressive forces applied for effecting fracture.

Thus, it can be seen that the pre sent invention provides a novel packaging assembly for at least two different, liquid and/or solid substance s which are to be post-mixed by the consumer. The assembly is of simple and economical construction, and is comprised of components that open easily and reliably, and that are preferably fixed in position relative to one another so as to facilitate admixture of the contained substances. The invention also provides a novel method for the production of a packaging assembly having the desired features and advantages, which method is relatively facile and economical to carry out.

Having thus described the invention, what is claimed is:

1. A packaging assembly for substances that are to be post-mixed, comprising: a tube that is integrally formed as a single piece from a synthetic resinous material, having forward and rearward ends with a continuous cavity of forwardly diminishing cross section extending therethrough and containing a first flowable substance, said tube including a closed, pliant body portion at said rearward end and a close d nozzle portion at said forward end thereof; and an ampule smaller than and contained within said tube and integrally formed as a single piece from a synthetic resinous material, said ampule having forward and rearward ends with a continuous cavity of forwardly diminishing cross section extending therethrough and containing a second flowable substance therewithin, and including a closed, pliant body portion at said rearward end and a closed frangible portion at said forward end thereof, said frangible portion being adapted to be fractured under manually applied compressive force to open said ampule, and being comprised of;

(a) a generally cylindrical sidewall element with an outer end;

(b) a blunt end wall element extending transversely across said forward end of said ampule; and (c) a transition element extending between said outer end of said sidewall element and said end wall element, and connecting them to one another, said transition element forming a sharp internal angle having a value of about 90° or less at one of the intersections with said sidewall element and said end wall element, over which angle said material is relatively thin; whereby compressive force applied in the region of said transition element will concentrate stress at said one intersection, thereby tending to cause fracture thereat.

2. The assembly of claim 1 wherein said transition element forms an internal arcute surface at the intersection with the other of said sidewall and end wall elements.

3. The assembly of claim 1 wherein said components are made of polypropylene and have a nominal wall thickness of 0.3 millimeter.

4. The assembly of claim 1 wherein said end wall is substantially planar, and said one intersection is formed therewith.

5. The assembly of claim 1 wherein said end wall is configured as a spheric section, and said one intersection is formed with said sidewall element at said outer end thereof.

6. The assembly of claim 1 wherein said nozzle portion of said tube is formed to provide integral frangible means for permitting opening thereof by the application of direct manual force thereto.

* * * * *